United States Patent [19]

Riley et al.

[11] Patent Number: 4,701,183

[45] Date of Patent: Oct. 20, 1987

[54] PROCESS FOR REMOVING SULFUR FROM COAL

[76] Inventors: John T. Riley, 1511 Woodhurst Dr., Bowling Green, Ky. 42101; Dwight D. Watson, 5408 Apple La., West Deptford, N.J. 08066

[21] Appl. No.: 776,467

[22] Filed: Sep. 16, 1985

[51] Int. Cl.[4] ..... C10L 9/06

[52] U.S. Cl. ..... 44/1 SR; 201/17

[58] Field of Search ..... 44/1 SR, 1 R; 201/17; 423/461

[56] References Cited

U.S. PATENT DOCUMENTS

| | | | |
|---|---|---|---|
| 3,214,346 | 10/1965 | Mason et al. | 201/17 |
| 3,393,978 | 7/1968 | Murphy et al. | 201/17 |
| 4,047,898 | 9/1977 | Cole et al. | 44/1 SR |
| 4,054,421 | 10/1977 | Robinson et al. | 44/1 SR |
| 4,260,471 | 4/1981 | Miller | 44/1 SR |
| 4,400,176 | 8/1983 | Kutta | 44/1 R |
| 4,424,062 | 1/1984 | Kamino et al. | 44/1 SR |

*Primary Examiner*—Carl F. Dees

*Attorney, Agent, or Firm*—Jon C. Winger

[57] ABSTRACT

A process for removing sulfur from coal comprising the steps of forming a slurry of coal, a carrier liquid, and a compound selected from the group consisting of carboxylic acid, percarboxylic acid, salts of carboxylic acid, and salts of percarboxylic acid, and any combination thereof.

8 Claims, No Drawings

PROCESS FOR REMOVING SULFUR FROM COAL

BACKGROUND OF THE INVENTION

1. Field of the Invention

The invention relates to desulfurizing coal, and more particularly to a process for removing sulfate, pyritic and especially organic sulfur from coal.

2. Discussion of Prior Art

There are three forms of sulfur in coal, pyritic, organic, and sulfate sulfur. Typically, the pyritic and organic sulfur contents are about the same in most Illinois Basin coals, while the sulfate sulfur content in most coals is very low. Present day commercial coal washing operations involve a separation of sulfur containing minerals as a function of their density. Inorganic sulfur compounds, mostly pyrites and marcasite, are more dense than the organic materials in coal. The density of a washing medium is adjusted so that the organic portion floats and the mineral components containing pyrite and marcasite sink to the bottom of the washing cell and are moved. This removes a portion of the pyritic sulfur, some of the sulfate sulfur and very, very little of the organic sulfur in coal.

A chemical cleaning process is needed to remove the organic sulfur from coal. Several methods of chemical cleaning of coal have been investigated. The Ledgemont Oxygen Leaching (LOL) Process uses 10–20 atm partial pressure oxygen, 130 degrees Celsius for 2 hours to remove up to 90% of the pyritic sulfur from pulverized coal. The organic sulfur is not affected. Under alkaline conditions 80–85% of the pyritic sulfur and 30–40% of the organic sulfur is removed. A known Oxydesulfurization Process is similar to the LOL Process but an iron-complexing agent such as oxalic acid or its salt is added to act as a promoter. Pyritic sulfur removal approaches 95% and organic sulfur removal approaches 35% for pulverized coals. This process typically employs alkaline solutions at 150 degrees Celsius and oxygen at 14 atmospheres to leach over 95% of the pyritic sulfur within 1 hour from certain coals. Organic sulfur removal varies from coal to coal but can approach 50%. In the oxidation by Nitrogen Oxides Process the active oxidizing agent is nitrogen dioxide. Pulverized coal is heated for 1 hour at 100 degrees Celsius under atmospheric pressure with a gas mixture of oxygen, nitrogen, nitrogen dioxide, and nitrogen oxide. The coal is then treated with hot caustic solution to remove the oxidized organic sulfur compounds. The pyritic sulfur and up to 40% of the organic sulfur can be removed.

None of the above processes have been developed commercially, due to the reaction requirements for the processes and the economics of implementing them.

SUMMARY OF THE INVENTION

The process of the present invention uses carboxylic acids and their salts which are relatively inexpensive materials (sodium formate, sodium acetate, etc.) and relatively mild reaction conditions. This chemical desulfurization process could be coupled with the present day coal washing operations, which removes a significant portion of the pyritic sulfur, to remove additional sulfur (primarily organic sulfur) from the coal.

A significant amount of the sulfur in coal is removed by treating the coal with carboxylic acids and/or salts. In experimentation, the sulfur occurs at 150 degrees Celsius, but is is likely that temperatures between ambient and 350 degrees Celsius would be effective in removing sulfur. Air is used to oxidize the sulfur and aid in its removal. The use of pure oxygen seems to enhance this reaction without degrading the coal. Of the carboxylic acids and their salts, formic acid and formate salts appear to perform best in the removal of organic sulfur, whereas iso-valeric acid and iso-valerate salts are effective in removing pyritic sulfur. It is anticipated that other carboxylic acids, their salts, and combinations of carboxylic acids and their salts would be effective in the removal of sulfur from coal and coal-derived products. Polycarboxylic acids such as nitrilotriacetic acid and ethylenediaminetetraacetic acid and their salts would also be effective in the removal of sulfur.

A systematic study of the removal of sulfur using various carboxylic acids and carboxylic acid salts was carried out. The pH of the reaction mixture was also varied. Various acids and salts were effective in removing the sulfur and a portion of the mineral matter from −8 mesh (2.4 mm) coal.

DETAILED DESCRIPTION OF THE PREFERRED EMBODIMENT

Various tests were conducted as follows:

Materials

All reagents used were of reagent grade. All reaction mixtures were prepared with water that had been deionized using an exchange column. The water used for rinsing had been deionized also. The air used to pressurize some of the reactions was designated breatheable quality.

Apparatus

The reactions were carried out in a 325 ml. stainless steel autoclave, capable of maintaining a maximum pressure of 3000 psi. The autoclave was manufactured by American Instruments (Model 40 12150SP, Series G6 3129). The vessel was heated by a thermostat controlled sleeve and is agitated by a pivoting rocker cam.

Procedure

Reactions were carried out using −8 mesh coal. These reactions represent a systematic attempt to optimize reaction conditions and reagents for removing sulfur. Carboxylic and Peracids were reacted under varying conditions.

The carboxylic acids were the first reactants to be studied. The acids used were: formic, acetic, propionic, butyric, valeric, iso-butyric, and iso-valeric.

In a first set of reactions each acid was reacted with ten grams of −8 mesh coal. One hundred milliliters of 2.0M acid was used in each case. The reaction mixture was placed in the autoclave and allowed to come to 150° C. The reaction time for all the experiments was one hour after a heat-up period of thirty minutes. The pressure in the reactor increased during the reaction because of reaction temperature. Reaction temperature of the autoclave was held at 150 degrees celsius. At the end of the reaction time, the pressure built up during the reaction was released. The reaction mixture was then immediately filtered.

The filtering procedure was Schleicher & Schuell #588 prefolded filter paper. This paper is 0.008 inches in thickness and is considered a fast filter paper. After the reactor had been rinsed into the filter, 100 ml. of boiling water was poured over the reaction coal mixture.

After the reaction coal mixture had drained, the filter paper was scraped with a spatial to remove the coal from the paper. The reaction coal was then transferred to a beaker and placed in a vacuum oven. The temperature of the oven was 110 degrees C. The reaction coal sample remained under vacuum for eighteen hours. After drying the sample was then pulverized in a high speed grinder. The sample had to be ground to a smaller particle size so that full analysis could be completed.

A second set of reaction mixtures containing 10 grams of coal and buffered solutions of the carboxylic acids were prepared by adding sodium hydroxide pellets to the acid solutions to neutralize one-half of the available acid, resulting in a reaction mixture that was 1M in the acid and the salt.

A third set of reaction mixtures containing salt solutions such as, for example, sodium formate, sodium acetate, sodium propronate, sodium butyrate, sodium valerate, sodium iso-bitryate, and sodium iso-valerate were prepared by adding a stoichiometric amount of base for example, sodium hydroxide to the acid to make a 2M solution of the salt.

A fourth set of reaction mixtures containing 10 grams of coal and basic salt reaction mixtures was made by adding one and one-half equivalents of base for example, sodium hydroxide, to the carboxylic acid, producing a solution that was 2M in the salt and 1M in sodium hydroxide.

A fifth set of reaction mixtures was prepared using peracids were prepared by adding 10 grams of coal and hydrogen peroxide to the acid solution. One milliliter of sulfuric acid was added to catalyze the formation of the peracids. The only peracids used were performic and peracetic. Reactions were carried out using the peracids, their buffered solution, their salt solutions and their basic salt solutions. Sodium hydroxide was used to form these mixtures. A base such as, for example, sodium hydroxide, was added one hour after the peracid mixture was made, and the mixture was cooled during the neutralization of the peracids to prevent decomposition of the peracids.

A sixth set of reaction mixtures were prepared by mixing 10 grams of coal and 100 ml. of 2M acid such as formic or acetic acid. The reaction mixture was reacted under an initial pressure of 600 psi. Air was used to pressurize the reactor to 600 psi. The sixth set of reaction mixture was carried out through the range of their respective acid, buffer and salt solutions.

A seventh set of reaction mixtures were prepared by mixing 10 grams of coal with a combination of formic and acetic solution. The reaction mixture was reacted under 600 psi pressure using air. These reaction solutions were 1M in both formic and acetic acids. This set of reaction mixtures was carried through the range of acid, buffer and salt solutions.

An eighth set of reaction mixtures containing 2M formic and 2M iso-valeric salts and 10 grams of coal were prepared using −60 mesh coal. The same reaction conditions were used during these experiments (150 degrees celsius, 2M solution in each salt, and one atmosphere initial pressure). The −60 mesh coals were filtered in the same way as the other reactions. However, the coals were not dried in a vacuum oven. Instead the coals were dried at 110 degrees celsius with an air flow to prevent loss of volatile matter by the vacuum.

Analysis of the Test Results

An analysis of the reaction products and initial starting coals were made to determine moisture, ash, volatile matter, fixed carbon by difference, and total sulfur. A LECO micro-processor controlled instrumentation was used in the analysis.

Forms of sulfur of all reacted coal samples was determined by ASTM procedure D 2492. A two to five gram sample was extracted with boiling hydrochloric acid (2:3 dilution). This removes sulfate sulfur and non-pyritic iron. The coal residue was filtered and ashed. The extracted sulfate sulfur is precipitated with barium chloride solution. Sulfate sulfur was then determined by gravimetric analysis of barium sulfate. The ashed coal residue was extracted with hydrochloric acid (2:3 dilution) and was diluted to a standard volume. The pyritic iron samples were then determined using a Varian atomic absorption spectrometer. After pyritic and sulfate sulfur was determined, their values were subtracted from the total sulfur percentage to give the organic sulfur percentage.

The results are shown in the following tables. Table 1 gives data resulting from the first reaction set; Table 2 shows the percentage reductions of the data of Table 1; Table 3 gives data resulting from the second reaction set; Table 4 shows the percentage reductions of the data of Table 3; Table 5 gives the data resulting from the third reaction set; Table 6 shows the percentage reductions of the data of Table 5; Table 7 gives the data resulting from the fourth reaction set; Table 8 shows the percentage reductions of the data of Table 7; Tables 9, 11, 13 and 15 give the data resulting from the fifth reaction set; Table 10, 12, 14 and 16 show the percentage reduction of Table 9, 11, 13 and 15, respectively; Tables 17, 19 and 21 give the data resulting from the sixth and seventh reaction sets; and Tables 18, 20 and 22 show the percent reduction of Tables 17, 19 and 21 respectively. Table 23 shows the percent reduction resulting from the eighth reaction set.

TABLE 1

| | Acid Reaction Analysis | | | | | |
|---|---|---|---|---|---|---|
| | Vol. Matter | Ash | Fixed Carbon | Total Sulfur | Organic Sulfur | Pyritic Sulfur |
| F | 42.91 | 9.34 | 57.09 | 3.95 | 2.58 | 1.3 |
| A | 43.48 | 9.72 | 56.52 | 3.91 | 2.17 | 1.69 |
| P | 43.37 | 9.64 | 56.52 | 3.87 | 2.28 | 1.71 |
| B | 40.36 | 9.67 | 56.04 | 3.84 | 2.3 | 1.54 |
| V | 44.93 | 9.73 | 55.07 | 4.02 | 2.5 | 1.53 |
| IB | 43.36 | 10.60 | 56.64 | 4.04 | 2.46 | 1.58 |
| IV | 43.65 | 9.73 | 56.35 | 3.92 | 2.67 | 1.25 |

Analysis percentages are in dry ash free basis except ash which is in dry basis.

TABLE 2

| | Acid Reaction Reductions | | | | | |
|---|---|---|---|---|---|---|
| | Vol. Matter | Ash | Fixed Carbon | Total Sulfur | Organic Sulfur | Pyritic Sulfur |
| F | −.43 | 14.39 | .29 | 5.5 | 5.49 | 10.34 |
| A | −1.76 | 10.9 | 1.29 | 6.45 | 20.51 | −16.59 |
| P | −1.5 | 11.64 | 1.11 | 7.41 | 16.48 | −17.94 |
| B | 5.54 | 11.36 | 2.13 | 8.13 | 15.75 | −6.21 |
| V | −5.15 | 10.81 | 3.82 | 3.82 | 8.42 | −5.52 |
| IB | −1.48 | 2.84 | 1.08 | 3.34 | 9.89 | −8.97 |

TABLE 2-continued

| | Acid Reaction Reductions | | | | | |
|---|---|---|---|---|---|---|
| | Vol. Matter | Ash | Fixed Carbon | Total Sulfur | Organic Sulfur | Pyritic Sulfur |
| IV | −2.16 | 10.81 | 1.58 | 6.22 | 2.19 | 13.79 |

All reductions in percent of original analysis
Negative sign means increase
F = formic acid
A = acetic acid
P = propionic acid
B = butyric acid
V = valeric acid
IB = iso-butyric acid
IV = iso-valeric acid

TABLE 3

| | Acid Buffer Reaction Analysis | | | | | |
|---|---|---|---|---|---|---|
| | Vol. Matter | Ash | Fixed Carbon | Total Sulfur | Organic Sulfur | Pyritic Sulfur |
| F | 43.11 | 9.22 | 56.89 | 3.92 | 2.49 | 1.41 |
| A | 43.16 | 9.22 | 56.84 | 3.79 | 2.46 | 1.34 |
| P | 43.29 | 9.78 | 56.71 | 3.86 | 2.20 | 1.67 |
| B | 42.88 | 9.52 | 57.12 | 3.91 | 2.50 | 1.41 |
| V | 44.08 | 9.33 | 55.92 | 3.74 | 2.6 | 1.14 |
| IB | 43.41 | 9.54 | 56.57 | 3.83 | 2.44 | 1.39 |
| IV | 43.67 | 9.85 | 56.33 | 3.77 | 2.53 | 1.24 |

Analysis percentages are in dry ash free basis except ash which is in dry basis.

TABLE 4

| | Acid Buffer Reaction Reductions | | | | | |
|---|---|---|---|---|---|---|
| | Vol. Matter | Ash | Fixed Carbon | Total Sulfur | Organic Sulfur | Pyritic Sulfur |
| F | −.89 | 15.49 | .64 | 6.22 | 8.79 | 2.75 |
| A | −1.01 | 15.49 | .73 | 9.33 | 9.89 | 7.58 |
| P | −1.32 | 10.35 | .96 | 7.65 | 19.41 | −15.18 |
| B | −.36 | 12.74 | .24 | 6.45 | 8.42 | 2.75 |
| V | −3.16 | 14.48 | 2.34 | 10.52 | 4.76 | 21.37 |
| IB | −1.6 | 12.55 | 1.2 | 8.37 | 10.62 | 4.13 |
| IV | −2.2 | 9.71 | 1.62 | 9.8 | 7.32 | 14.48 |

All reductions in percent of original analysis
Negative sign means increase
F = formic acid
A = acetic acid
P = propionic acid
B = butyric acid
V = valeric acid
IB = iso-butyric acid
IV = iso-valeric acid

TABLE 5

| | Acid Salt Analysis | | | | | |
|---|---|---|---|---|---|---|
| | Vol. Matter | Ash | Fixed Carbon | Total Sulfur | Organic Sulfur | Pyritic Sulfur |
| F | 42.55 | 11.12 | 57.45 | 3.89 | 2.1 | 1.79 |
| A | 41.52 | 12.17 | 58.48 | 3.99 | 2.28 | 1.71 |
| P | 43.15 | 10.57 | 56.85 | 4.02 | 21.8 | 1.84 |
| B | 42.45 | 9.72 | 57.55 | 3.94 | 2.4 | 1.54 |
| V | 43.94 | 10.35 | 56.05 | 4.01 | 2.55 | 1.46 |
| IB | 41.23 | 13.96 | 58.77 | 3.79 | 2.39 | 1.4 |
| IV | 43.15 | 9.97 | 56.85 | 3.81 | 2.57 | 1.24 |

Analysis percentages are in dry ash free basis except ash which is in dry basis.

TABLE 6

| | Acid Salt Reaction Reductions | | | | | |
|---|---|---|---|---|---|---|
| | Vol. Matter | Ash | Fixed Carbon | Total Sulfur | Organic Sulfur | Pyritic Sulfur |
| F | .42 | −1.93 | −.34 | 6.93 | 23.07 | −23.45 |
| A | 2.83 | −11.55 | −2.14 | 4.54 | 16.48 | −17.94 |
| P | −.99 | 3.11 | .71 | 3.82 | 20.14 | −26.9 |
| B | .65 | 10.9 | −.51 | 5.74 | 12.08 | −6.21 |
| V | −2.84 | 5.13 | 2.11 | 4.06 | 6.59 | −.69 |
| IB | 3.51 | −27.96 | −2.64 | 9.33 | 12.45 | 3.44 |

TABLE 6-continued

| | Acid Salt Reaction Reductions | | | | | |
|---|---|---|---|---|---|---|
| | Vol. Matter | Ash | Fixed Carbon | Total Sulfur | Organic Sulfur | Pyritic Sulfur |
| IV | −.99 | 8.61 | .71 | 8.85 | 5.86 | 14.48 |

All reductions in percent of original analysis
Negative sign means increase
F = formic acid
A = acetic acid
P = propionic acid
B = butyric acid
V = valeric acid
IB = iso-butyric acid
IV = iso-valeric acid

TABLE 7

| | Basic Acid Salt Reaction Analysis | | | | | |
|---|---|---|---|---|---|---|
| | Vol. Matter | Ash | Fixed Carbon | Total Sulfur | Organic Sulfur | Pyritic Sulfur |
| OH | 41.56 | 14.65 | 58.44 | 4.29 | 2.19 | 2.10 |
| F | 41.53 | 12.03 | 58.47 | 3.91 | 2.24 | 1.68 |
| A | 41.54 | 11.67 | 58.46 | 3.86 | 2.48 | 1.37 |
| P | 41.71 | 11.91 | 58.29 | 3.77 | 2.35 | 1.42 |
| B | 40.97 | 12.75 | 59.02 | 3.86 | 2.48 | 1.38 |
| V | 42.00 | 15.35 | 58.00 | 3.93 | 2.38 | 1.55 |
| IB | 42.62 | 10.78 | 57.38 | 3.87 | 2.68 | 1.19 |
| IV | 41.25 | 14.41 | 58.75 | 3.73 | 2.53 | 1.2 |

Analysis percentages are in dry ash free basis except ash which is in dry basis.

TABLE 8

| | Basic Acid Salt Reaction Reductions | | | | | |
|---|---|---|---|---|---|---|
| | Vol. Matter | Ash | Fixed Carbon | Total Sulfur | Organic Sulfur | Pyritic Sulfur |
| OH | 2.73 | −34.29 | −2.07 | −2.64 | 19.78 | −44.83 |
| F | 2.8 | −10.27 | −2.12 | 6.45 | 17.94 | −15.87 |
| A | 2.78 | −6.97 | −2.1 | 7.65 | 9.15 | 5.51 |
| P | 2.38 | −9.17 | −1.8 | 9.8 | 13.91 | 2.06 |
| B | 4.11 | −16.87 | −3.08 | 7.65 | 9.15 | 4.82 |
| V | 1.7 | −40.7 | −1.3 | 5.98 | 12.82 | −6.9 |
| IB | .25 | 1.19 | −.21 | 7.41 | 1.83 | 17.93 |
| IV | 3.46 | −32.09 | −2.61 | 10.76 | 7.32 | 17.24 |

All reductions in percent of original analysis
Negative sign means increase
F = formic acid
A = acetic acid
P = propionic acid
B = butyric acid
V = valeric acid
IB = iso-butyric acid
IV = iso-valeric acid

TABLE 9

| | Peracid Analysis | | | | | |
|---|---|---|---|---|---|---|
| | Vol. Matter | Ash | Fixed Carbon | Total Sulfur | Organic Sulfur | Pyritic Sulfur |
| $H_2O_2$ | 43.14 | 9.03 | 56.86 | 3.37 | 2.28 | .77 |
| F | 43.28 | 8.91 | 56.72 | 3.41 | 2.32 | .76 |
| A | 43.33 | 8.67 | 56.67 | 3.26 | 2.46 | .46 |

Analysis percentages are in dry ash free basis except ash which is in dry basis.

TABLE 10

| | Peracid Reductions | | | | |
|---|---|---|---|---|---|
| | Vol. Matter | Ash | Total Sulfur | Organic Sulfur | Pyritic Sulfur |
| $H_2O_2$ | −.96 | 17.23 | 19.37 | 16.48 | 46.89 |
| F | −1.29 | 18.33 | 18.42 | 15.01 | 47.58 |
| A | −1.41 | 20.53 | 22 | 9.89 | 68.27 |

All reductions in percent of original analysis
Negative sign means increase
F = formic acid
$H_2O_2$ = 1 M in $H_2O_2$
A = acetic acid

TABLE 11

| | Peracid Buffer Analysis | | | | | |
|---|---|---|---|---|---|---|
| | Vol. Matter | Ash | Fixed Carbon | Total Sulfur | Organic Sulfur | Pyritic Sulfur |
| F | 42.75 | 9.36 | 57.25 | 3.46 | 2.345 | .77 |
| A | 42.87 | 9.59 | 57.13 | 3.52 | 2.80 | .73 |

Analysis percentages are in dry ash free basis except ash which is in dry basis.

TABLE 12

| | Basic Acid Salt Reaction Reductions | | | | | |
|---|---|---|---|---|---|---|
| | Vol. Matter | Ash | Fixed Carbon | Total Sulfur | Organic Sulfur | Pyritic Sulfur |
| F | −.05 | 14.2 | .01 | 17.22 | 14.1 | 46.89 |
| A | −.33 | 12.09 | .22 | 15.78 | −2.57 | 49.65 |

All reductions in percent of original analysis
Negative sign means increase
F = formic acid
A = acetic acid

TABLE 13

| | Peracid Salt Analysis | | | | | |
|---|---|---|---|---|---|---|
| | Vol. Matter | Ash | Fixed Carbon | Total Sulfur | Organic Sulfur | Pyritic Sulfur |
| F | 42.52 | 11.00 | 57.48 | 3.69 | 2.63 | 1.04 |
| A | 42.92 | 9.26 | 57.08 | 3.47 | 2.55 | .90 |

Analysis percentages are in dry ash free basis except ash which is in dry basis.

TABLE 14

| | Peracid Salt Reductions | | | | | |
|---|---|---|---|---|---|---|
| | Vol. Matter | Ash | Fixed Carbon | Total Sulfur | Organic Sulfur | Pyritic Sulfur |
| F | .49 | −.83 | −.39 | 11.72 | 3.66 | 28.27 |
| A | −.45 | 15.12 | .31 | 16.98 | 6.59 | 37.93 |

All reductions in percent of original analysis
Negative sign means increase
F = formic acid
A = acetic acid

TABLE 15

| | Basic Peracid Salt | | | | | |
|---|---|---|---|---|---|---|
| | Vol. Matter | Ash | Fixed Carbon | Total Sulfur | Organic Sulfur | Pyritic Sulfur |
| F | 42.55 | 13.88 | 57.45 | 3.63 | 2.59 | 1.02 |
| A | 42.97 | 9.69 | 57.03 | 3.58 | 2.76 | .81 |

Analysis percentages are in dry ash free basis except ash which is in dry basis.

TABLE 16

| | Basic Peracid Salt Reductions | | | | | |
|---|---|---|---|---|---|---|
| | Vol. Matter | Ash | Fixed Carbon | Total Sulfur | Organic Sulfur | Pyritic Sulfur |
| F | .42 | −27.23 | −.34 | 13.15 | 5.12 | 29.65 |
| A | −.57 | 11.18 | .4 | 14.35 | −1.1 | 44.13 |

All reductions in percent of original analysis
Negative sign means increase
F = formic acid
A = acetic acid

TABLE 17

| | Pressurized Acid Analysis | | | | | |
|---|---|---|---|---|---|---|
| | Vol. Matter | Ash | Fixed Carbon | Total Sulfur | Organic Sulfur | Pyritic Sulfur |
| $H_2O$ | 42.73 | 10.68 | 57.27 | 3.87 | 2.64 | 1.19 |
| F | 42.69 | 9.84 | 57.31 | 3.81 | 2.63 | 1.16 |
| A | 42.75 | 9.46 | 57.25 | 3.85 | 2.85 | .98 |
| F + A | 42.67 | 9.53 | 57.33 | 3.83 | 3.03 | 1.28 |

Analysis percentages are in dry ash free basis except ash which is in dry basis.

TABLE 18

| | Pressurized Acid Reductions | | | | | |
|---|---|---|---|---|---|---|
| | Vol. Matter | Ash | Fixed Carbon | Total Sulfur | Organic Sulfur | Pyritic Sulfur |
| $H_2O$ | 0 | 2.1 | −.02 | 7.41 | 3.29 | 17.93 |
| F | .09 | 9.8 | −.09 | 8.85 | 3.66 | 20 |
| A | −.05 | 13.29 | .01 | 7.89 | −4.4 | 32.41 |
| F + A | .14 | 12.64 | −.13 | 8.37 | −10.99 | 11.72 |

All reductions in percent of original analysis
Negative sign means increase
$H_2O$ = water blank reaction run
A = acetic acid
F = formic acid
F + A = formic and acetic acid combination

TABLE 19

| | Pressurized Acid Buffer Analysis | | | | | |
|---|---|---|---|---|---|---|
| | Vol. Matter | Ash | Fixed Carbon | Total Sulfur | Organic Sulfur | Pyritic Sulfur |
| F | 42.75 | 9.88 | 57.25 | 3.94 | 2.65 | 1.28 |
| A | 42.03 | 10.15 | 57.99 | 3.80 | 2.58 | 1.2 |
| F + A | 42.46 | 10.38 | 57.54 | 4.08 | 2.77 | 1.31 |

Analysis percentages are in dry ash free basis except ash which is in dry basis.

TABLE 20

| | Pressurized Acid Buffer Reductions | | | | | |
|---|---|---|---|---|---|---|
| | Vol. Matter | Ash | Fixed Carbon | Total Sulfur | Organic Sulfur | Pyritic Sulfur |
| F | −.08 | 9.44 | .01 | 5.74 | 2.93 | 11.72 |
| A | 1.61 | 6.96 | −1.28 | 9.09 | 5.49 | 17.24 |
| F + A | .6 | 4.85 | −.49 | 2.39 | −1.47 | 9.65 |

All reductions in percent of original analysis
Negative sign means increase
F = formic acid
A = acetic acid
F + A = formic and acetic acid combination

TABLE 21

| | Pressurized Acid Salt Analysis | | | | | |
|---|---|---|---|---|---|---|
| | Vol. Matter | Ash | Fixed Carbon | Total Sulfur | Organic Sulfur | Pyritic Sulfur |
| F | 41.84 | 11.25 | 57.51 | 3.89 | 2.45 | 1.45 |
| A | 42.32 | 10.89 | 57.68 | 3.86 | 2.52 | 1.32 |
| F + A | 42.72 | 11.82 | 57.28 | 4.1 | 2.71 | 1.38 |

Analysis percentages are in dry ash free basis except ash which is in dry basis.

TABLE 22

| | Pressurized Acid Buffer Reductions | | | | | |
|---|---|---|---|---|---|---|
| | Vol. Matter | Ash | Fixed Carbon | Total Sulfur | Organic Sulfur | Pyritic Sulfur |
| F | 2.08 | −3.12 | −.44 | 6.93 | 10.25 | 0 |
| A | .95 | .18 | −.74 | 7.65 | 7.69 | 8.96 |
| F + A | .02 | −8.35 | −.04 | 1.91 | .73 | 4.82 |

All reductions in percent of original analysis
Negative sign means increase
F = formic acid
A = acetic acid
F + A = formic and acetic acid combination

TABLE 23

| | Sulfur Reductions of Reacted −60 Mesh Coals | | | |
|---|---|---|---|---|
| Run No. | Total Sulfur | Organic Sulfur | Pyritic Sulfur | Sulfate Sulfur |
| 1 | 16.03 | 8.40 | 41.38 | −177.8 |
| 2 | 14.35 | 5.34 | 49.66 | −300.0 |
| 3 | 24.03 | 79.44 | −22.5 | −80.00 |
| 4 | 3.33 | 19.80 | −19.18 | −100.00 |
| 5 | 5.34 | 28.35 | −62.22 | 0.00 |

TABLE 23-continued

| Sulfur Reductions of Reacted −60 Mesh Coals | | | | |
|---|---|---|---|---|
| Run No. | Total Sulfur | Organic Sulfur | Pyritic Sulfur | Sulfate Sulfur |
| 6 | 23.51 | 46.99 | 12.96 | −100.00 |

All reductions in percent of original analysis
Negative sign means increase

A ninth set of reaction mixtures were prepared using eight mesh coals having three different initial sulfur contents. A first process was carried out with each of the three mixtures to remove pyritic sulfur.

In the first process, 20 grams of the coal was mixed with 100 ml of water to form a coal-water slurry in a bomb reactor vessel. The vessel was then pressurized to 10 atmospheres using essentially pure oxygen. The vessel was heated to 150° C. and maintained at 150° C. for about one hour. The vessel was allowed to cool to a temperature for safe handling. The slurry was removed from the vessel and filtered to separate out the soluble sulfate sulfur. The filtered resulting coal product was washed with 100 ml of 2 grams/100 ml of sodium bicarbonate to remove residual soluble sulfate sulfur. The washed resulting coal product was then allowed to dry. The resulting coal product was then analyzed to determine the percent change in organic, pyritic and sulfate sulfur from the initial amounts thereof. The results are shown in the following Tables 24, 25, 26, 27, 28 and 29.

Analysis of initial sulfur content of first coal:
Total sulfur: 2.98
Organic sulfur: 0.81
Pyritic sulfur: 2.16
Sulfate sulfur: 0.01
(Negative reations are increases)

TABLE 24

| | Preoxidation reations | |
|---|---|---|
| RUN #101 | % | % Reduction |
| Tot. S. | 1.32 | 55.7 |
| Org. S. | 0.89 | −9.8 |
| Pyr. S. | 0.31 | 85.6 |
| Sul. S. | 0.16 | — |

TABLE 25

| | Preoxidation reactions | |
|---|---|---|
| RUN #102 | % | % Reduction |
| Tot. S. | 1.37 | 54.0 |
| Org. S. | 0.87 | −7.4 |
| Pyr. S. | 0.34 | 84.3 |
| Sul. S. | 0.16 | — |

TABLE 26

| | Preoxidation reactions | |
|---|---|---|
| RUN #103 | % | % Reduction |
| Tot. S. | 1.40 | 53.0 |
| Org. S. | 0.69 | 14.8 |
| Pyr. S. | 0.59 | 72.7 |
| Sul. S. | 0.10 | — |

Analysis of initial sulfur content of second coal:
Total Sulfur: 4.18
Organic Sulfur: 2.62
Pyritic Sulfur: 1.45
Sulfate Sulfur: 0.09

TABLE 27

| | Preoxidation reations | |
|---|---|---|
| RUN #201 | % | % Reduction |
| Tot. S. | 2.99 | 28.4 |
| Org. S. | 2 38 | 9.1 |
| Pyr. S. | 0.40 | 72.4 |
| Sul. S. | 0.21 | — |

TABLE 28

| | Preoxidation reactions | |
|---|---|---|
| RUN #202 | % | % Reduction |
| Tot. S. | 2.96 | 29.2 |
| Org. S | 2.49 | 4.8 |
| Pyr. S. | 0.32 | 77.9 |
| Sul. S. | 0.15 | — |

Analysis of initial sulfur content of third coal:
Total Sulfur: 2.33
Organic Sulfur: 1.07
Pyritic Sulfur: 1.20
Sulfate Sulfur: 0.05

TABLE 29

| | Preoxidation reations | |
|---|---|---|
| RUN #301 | % | % Reduction |
| Tot. S. | 1.26 | 45.9 |
| Org. S. | 0.51 | 52.3 |
| Pyr. S. | 0.62 | 48.3 |
| Sul. S. | 0.12 | — |

A second process was carried out on each of the above resulting coal products particularly to remove organic sulfur therefrom.

In the second process, 10 grams of the resulting coal product was mixed with 100 ml of water to form a coal product-water slurry in a bomb reactor vessel. In the first and second runs using the coal products resulting from the first process of the first coal 0.2 moles of sodium formate was added to the coal product-water slurry. In the subsequent runs using coal products resulting from the first process of the first coal, and all of the runs using coal products resulting from the first process of the second and third coals, 0.4 moles of sodium formate was added to the coal product-water slurry. Each coal-product-water/sodium formate slurry was pressurized in the bomb vessel to three atmospheres using essentially pure oxygen. The vessel was heated to 150° C. and maintained at 150° C. for about one hour. The vessel was allowed to cool to a temperature for safe handling. The resulting slurry was removed from the vessel and filtered to separate out the soluble sulfate sulfur. The filtered resulting coal product was washed with 100 ml of water to remove residual soluble sulfate products. The washed resulting coal was then analyzed to determine the percent change in organic, pyritic and sulfate sulfur from the amounts remaining in the respective coals from the first process. The results are shown in the following Tables 30, 31, 32, 33, 34 and 35.

SULFUR ANALYSIS OF FIRST COAL

TABLE 30

| RUN #111 | % | % Reduction |
|---|---|---|
| Tot. S. | 1.03 | 65.4 |
| Org. S. | 0.56 | 30.9 |
| Pyr. S. | 0.39 | 81.9 |
| Sul. S. | 0.08 | — |

TABLE 31

| RUN #112 | % | % Reduction |
|---|---|---|
| Tot. S. | 1.06 | 64.4 |
| Org. S. | 0.64 | 21.0 |
| Pyr. S. | 0.35 | 83.8 |
| Sul. S. | 0.06 | — |

TABLE 32

| RUN #113 | % | % Reduction |
|---|---|---|
| Tot. S. | 1.12 | 62.4 |
| Org. S. | 0.42 | 48.1 |
| Pyr. S. | 0.64 | 70.3 |
| Sul. S. | 0.07 | — |

SULFUR ANALYSIS OF SECOND COAL

TABLE 33

| | Sodium Formate Reactions: | |
|---|---|---|
| RUN #211 | % | % Reduction |
| Tot. S. | 2.78 | 33.5 |
| Org. S. | 2.24 | 14.5 |
| Pyr. S. | 0.47 | 67.5 |
| Sul. S. | 0.06 | — |

TABLE 34

| RUN #212 | % | % Reduction |
|---|---|---|
| Tot. S. | 2.72 | 34.9 |
| Org. S. | 2.15 | 17.9 |
| Pyr. S. | 0.51 | 64.8 |
| Sul. S. | 0.05 | — |

SULFUR ANALYSIS OF THIRD COAL

TABLE 35

| | Sodium Formate Reaction: | |
|---|---|---|
| RUN #311 | % | % Reduction |
| Tot. S. | 1.11 | 52.3 |
| Org. S. | 0.46 | 57.0 |
| Pyr. S. | 0.55 | 54.2 |
| Sul. S. | 0.09 | — |

From the foregoing, it can be concluded that carboxylic acids, percarboxylic acids, and the salts thereof are instrumental in the removal of organic sulfur from coal. Furthermore, it appears that of the carboxylic acids, percarboxylic acids, and the salts thereof, that formic acids, performic acids, formate salts, and performate salts function more efficiently than the others.

It is speculated from the above discussed tests that in addition to carboxylic acid, percarboxylic acids, and salts thereof that any compound containing a carboxylate group would also be useful to remove organic sulfur from coal. By carboxylate group, it is meant the following structure:

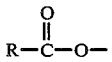

Where:

O is oxygen

C is carbon

R is hydrogen or a hydrocarbon group

In addition, it is contemplated that pressurizing the coal-water slurry with an inert gas instead of air or oxygen will also function in the process for removing organic sulfur from coal when using formic acid or its salts because of what their reducing properties due to the particular

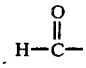

group thereof.

The foregoing detailed description is given primarily for clearness of understanding and no unnecessary limitations are to be understood therefrom for modifications will become obvious to those skilled in the art upon reading the disclosure and may be made without departing from the spirit of the invention and scope of the appended claims.

What is claimed is:

1. A process for removing sulfur from coal comprising the steps of:

forming a slurry of sulfur containing coal; carrier liquid and a compound selected from the group consisting of carboxylic acids, percarboxylic acids, salts of carboxylic acids, salts of percarboxylic acids, and any combination;

heating the slurry in an atmosphere containing oxygen gas; and, separating the coal from the other slurry components after heating.

2. The process of claim 1 wherein the step of heating the slurry comprises heating the slurry to at least the boiling temperature of the carrier liquid.

3. The process of claim 1 comprising pressurizing the slurry while heating the slurry.

4. The process of claim 3 wherein the step of heating the pressurized slurry comprises heating the pressurized slurry to at least the boiling temperature of the liquid carrier.

5. The process of claim 1 wherein the carrier liquid is water.

6. The process of claim 1 wherein the compound group consists of formic acid, salts of formic acid, performic acid, salts of performic acid, and any combination thereof.

7. A process for removing sulfur from coal comprising the steps of:

forming a slurry of sulfur containing coal, carrier liquid, and a compound having a carboxylate containing group;

heating the slurry in an atmosphere containing oxygen gas to a reaction temperature of at least the boiling temperature of the carrier liquid and maintaining the slurry constant at the reaction temperature for a period of time sufficient to permit the coal and selected compound to react; and, separating the coal from the other slurry components at the end of the reaction time.

8. The process of claim 7 further comprising pressurizing the slurry while heating the slurry.

* * * * *